US008384602B2

(12) United States Patent
Anderson

(10) Patent No.: US 8,384,602 B2
(45) Date of Patent: Feb. 26, 2013

(54) PLASMA DEVICES FOR STEERING AND FOCUSING ANTENNA BEAMS

(76) Inventor: Theodore R. Anderson, Brookfield, MA (US)

( * ) Notice: Subject to any disclaimer, the term of this patent is extended or adjusted under 35 U.S.C. 154(b) by 384 days.

(21) Appl. No.: 12/841,340

(22) Filed: Jul. 22, 2010

(65) Prior Publication Data

US 2011/0025565 A1 Feb. 3, 2011

Related U.S. Application Data

(60) Provisional application No. 61/230,936, filed on Aug. 3, 2009.

(51) Int. Cl.
*H01Q 1/26* (2006.01)

(52) U.S. Cl. ..... 343/701

(58) Field of Classification Search ..... 343/701, 343/754, 909

See application file for complete search history.

(56) References Cited

U.S. PATENT DOCUMENTS

| | | | | |
|---|---|---|---|---|
| 3,544,998 | A * | 12/1970 | Vandenplas et al. | 343/701 |
| 5,963,169 | A | 10/1999 | Anderson | |
| 6,657,594 | B2 | 12/2003 | Anderson | |
| 6,700,544 | B2 | 3/2004 | Anderson | |
| 6,710,746 | B1 | 3/2004 | Anderson et al. | |
| 6,812,895 | B2 | 11/2004 | Anderson et al. | |
| 6,842,146 | B2 | 1/2005 | Alexeff et al. | |
| 6,870,517 | B1 * | 3/2005 | Anderson | 343/909 |
| 6,876,330 | B2 | 4/2005 | Alexeff et al. | |
| 6,922,173 | B2 | 7/2005 | Anderson | |
| 7,292,191 | B2 | 11/2007 | Anderson | |
| 7,342,549 | B2 | 3/2008 | Anderson | |
| 7,453,403 | B2 | 11/2008 | Anderson | |
| 2003/0142021 | A1 * | 7/2003 | Anderson | 343/701 |
| 2004/0041741 | A1 * | 3/2004 | Hayes | 343/909 |

* cited by examiner

*Primary Examiner* — Hoang V Nguyen

(74) *Attorney, Agent, or Firm* — Notaro, Michalos & Zaccaria P.C.

(57) ABSTRACT

A plasma array of plural plasma containers of selected shapes and a selected spacial distribution, contain variable plasma density within each container and from one container to the next for establishing plasma frequency ranges from zero to an arbitrary plasma frequency. The plasma array is operating in a mode to transmit, receive, filter, reflect and/or refract radiation.

24 Claims, 4 Drawing Sheets

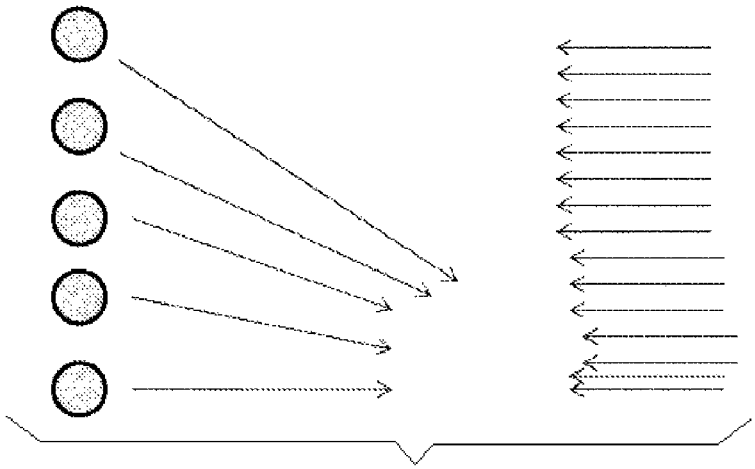
FIG. 2B
FIG. 9
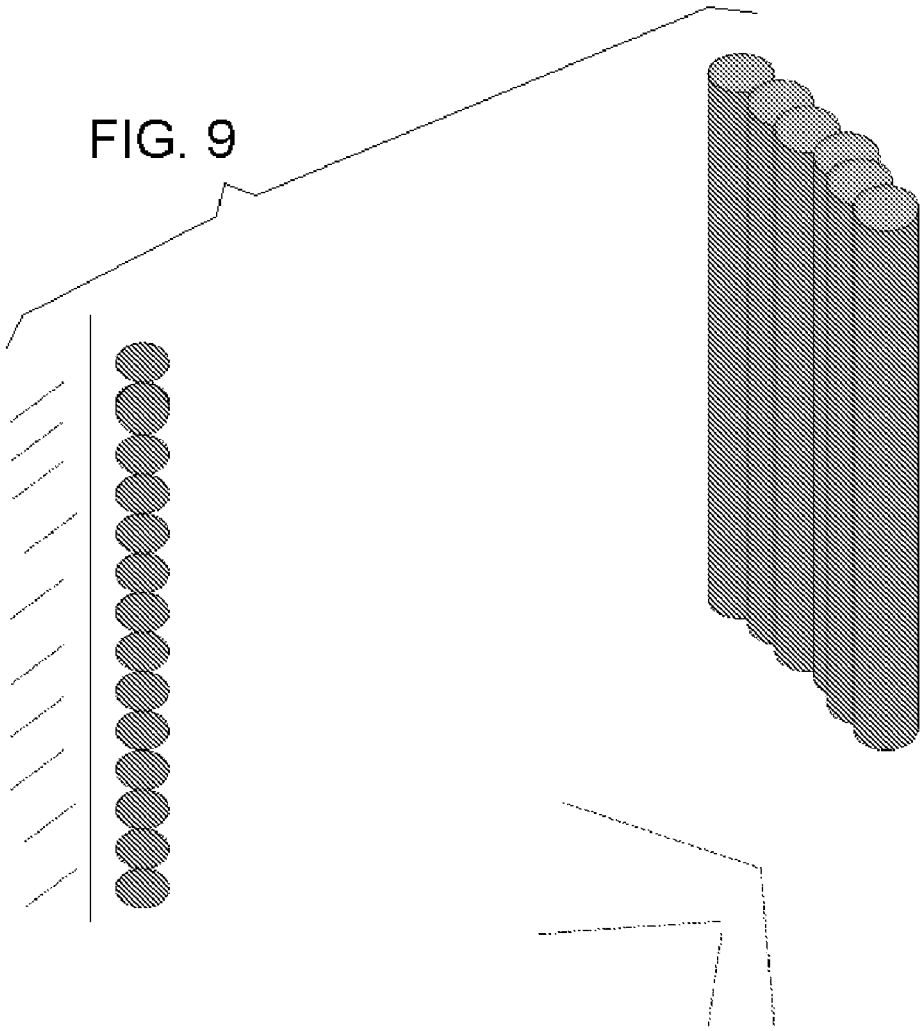

FIG. 3
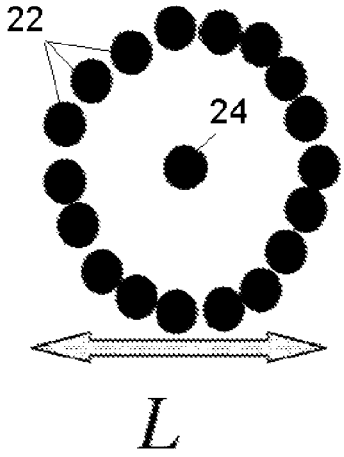
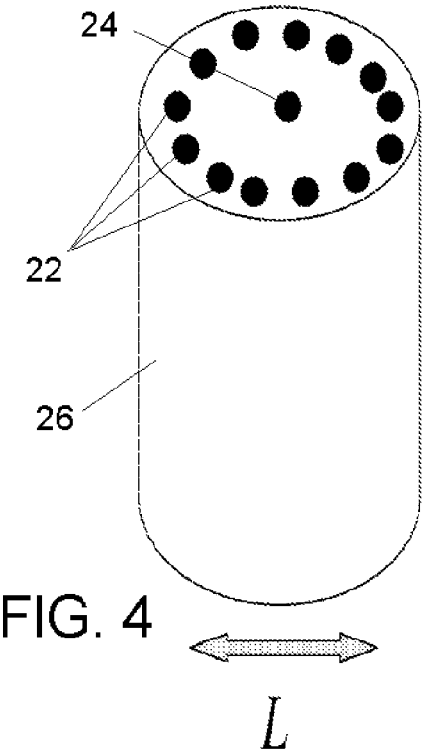
FIG. 4
FIG. 5
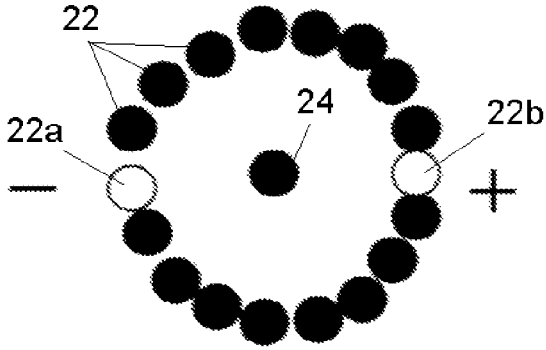
FIG. 6
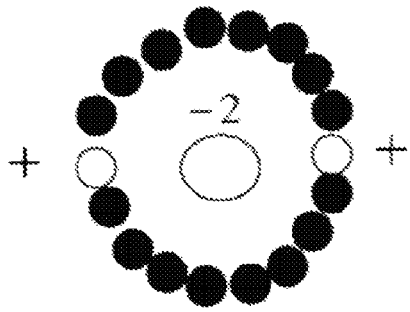

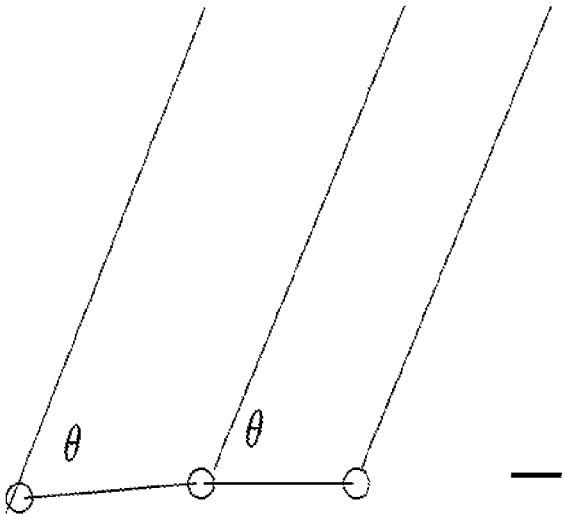
FIG. 7
FIG. 8
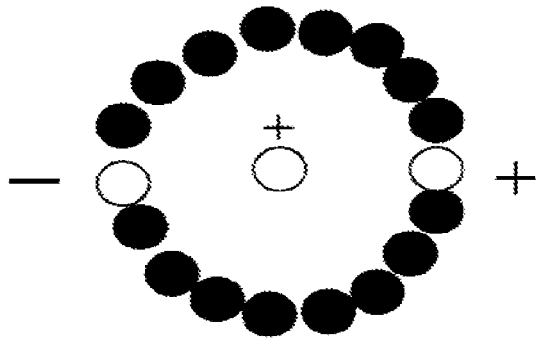
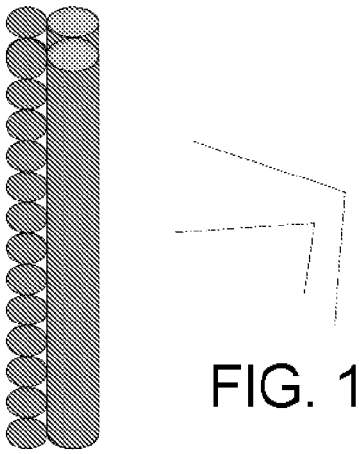
FIG. 10

PLASMA DEVICES FOR STEERING AND FOCUSING ANTENNA BEAMS

CROSS REFERENCE TO RELATED APPLICATION

This application claims priority on U.S. Provisional Patent Application 61/230,936 filed Aug. 3, 2009, which is incorporated here by reference.

FIELD AND BACKGROUND OF THE INVENTION

The present invention relates generally to the field of antennas and, in particular, to a new and useful plasma array that can be used for transmitting, receiving, filtering, reflecting and/or refracting radiation, particularly EM radiation.

Traditionally, antennas have been defined as metallic devices for radiating or receiving radio waves. The paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature.

Plasma antennas have far more flexibility and potential than metallic devices, however. The inventor has made many contributions to the field of plasma antennas.

See, for example U.S. Pat. No. 7,453,403 for Tunable Plasma Frequency Devices that discloses a reduced noise and selectively configurable plasma device that is capable of interpreting electromagnetic signals and that has a plasma mechanism with a plasma that is ionizable to a plasma frequency. An ionizing mechanism for ionizing the plasma and a control that is operative to control the ionizing mechanism, ionizes the plasma to the plasma frequency by application of plasma ionizing energy pulses. An interpreting mechanism operates to interpret the electromagnetic signals only in a period between ionization of the plasma with the energy pulses. U.S. Pat. No. 7,453,403 is incorporated here by reference for its teaching of how to establish a plasma in a container of a density and frequency for use as part of a plasma antenna.

U.S. Pat. No. 7,342,549 for Configurable Arrays for Steerable Antennas and Wireless Network Incorporating the Steerable Antennas discloses a reconfigurable array of variable conductive elements provided for reflecting, filtering and steering electromagnetic radiation across a wide range of frequencies. The reconfigurable array is combined with a transmitting antenna to make a steerable antenna. The reconfigurable array surrounds the transmitting antenna and reflects all transmissions except on selected radials where apertures in the reconfigurable array are formed for permitting transmission lobes.

Also see U.S. Pat. No. 6,876,330 for Reconfigurable Antennas that discloses an antenna element comprising at least two conductive elements, and a gas or vapor filled bulb or tube positioned between the conductive elements is provided. The fluid is capable of ionization such that when the fluid in the bulb or tube is energized, the conductive elements electrically communicate with one another, and when the fluid is not energized, the conductive elements do not electrically communicate with one another.

U.S. Pat. No. 5,963,169 for a Multiple Tube Plasma Antenna discloses an antenna in which electromagnetic signals in the high frequency and super high frequency bands are propagated utilizing ionized gas, or plasma. Energized electrodes ionize the gas and the plasma is confined within non-metallic coaxial tubes contained within a non-metallic pressure vessel. Electric field gradients are used to change the shape and density of the plasma to affect the gain and directivity of the antenna. The inner plasma tube acts as the radiating source, while the outer plasma tube is used to change the radiation of the inner tube and to reflect the radiated signal. Instrumentation measures the density of the plasma providing a means to measure incoming signals as well as to regulate the radiation frequency. U.S. Pat. No. 5,963,169 is also incorporated here by reference for its teaching of how to establish a plasma in a container of a density and frequency for use as part of a plasma antenna.

Other relevant patents are U.S. Pat. No. 6,657,594 for a Plasma Antenna System and Method; U.S. Pat. No. 6,700,544 for a Near Field Plasma Reader; U.S. Pat. No. 6,710,746 for an Antenna Having Reconfigurable Length; U.S. Pat. No. 6,812,895 for a Reconfigurable Electromagnetic Plasma Waveguide; U.S. Pat. No. 6,842,146 for a Plasma Filter Antenna System; U.S. Pat. No. 6,870,517 for Configurable Arrays for Steerable Antennas; and U.S. Pat. No. 6,922,173 for a Reconfigurable Scanner and RFID System.

A need remains of a plasma array that can be operated in a wide variety of modes so as to effectively and efficiently transmit, receive, filter, reflect and/or refract radiation.

SUMMARY OF THE INVENTION

It is an object of the present invention to provide a plasma array of plural plasma containers of selected shapes and a selected spacial distribution, contain variable plasma density within each container and from one container to the next for establishing plasma frequency ranges from zero to an arbitrary plasma frequency.

Plasma antenna, or more generally, plasma arrays, have many advantages over metal antennas or other metal structures for effecting radiation, as, for example, satellite antennas. These included the fact that: plasma antennas and arrays have much less thermal noise than metal antennas at satellite frequencies; plasma antennas have higher data rates than corresponding metal antennas at satellite frequencies; plasma antennas are reconfigurable and metal antennas are not; an arrangement of plasma antennas can be physically flat but effectively parabolic; they are better for antenna aesthetics and an arrangement of plasma antennas can electronically focus and steer RF signals without phased arrays. Applications for both static (e.g. Direct TV) and dish antennas attached to vehicles, ships, or aircraft, are also possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2B is a view of some of the plasma tubes or antennas of the first embodiment for steering a microwave beam with incident RF waves on the left impinging on the plasma tubes with different densities but with the plasma densities below cutoff;

FIG. 3 is a schematic top view of a second embodiment of the invention;

FIG. 4 is a perspective view of the second embodiment including an encasement for ease of mounting of the antenna;

FIG. 5 is a view similar to FIG. 3 of the second embodiment during one mode of operation;

FIG. 6 is a view similar to FIG. 3 of the second embodiment during another mode of operation;

FIG. 7 schematic showing illustrating a principle of operation of the invention;

FIG. 8 is a view similar to FIG. 3 of the second embodiment during a still further mode of operation;

FIG. 9 is a view of the arrangement of plasma tubes of the invention where both banks of tubes have plasma densities above cutoff and are therefore reflective; and FIG. 10 is a view of the invention similar to that of FIG. 1 but where both banks of tubes have plasma densities below cutoff and are therefore both refractive.

DESCRIPTION OF THE PREFERRED EMBODIMENTS

Figure 1:
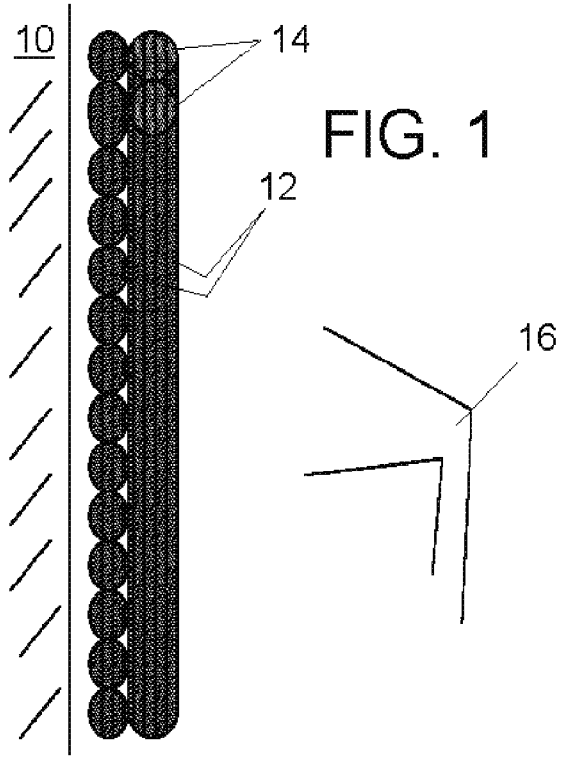
FIG. 1 is a schematic perspective illustration of a first embodiment of the invention.

Referring now to the drawings, in which like reference numerals are used to refer to the same or similar elements, FIGS. 1 and 3 show two embodiments of plasma arrays with a plurality of plasma containers of selected shapes and selected spacial distribution. The containers contain variable plasma density within each container and from one container to the next for establishing plasma frequency ranges from zero to an arbitrary plasma frequency.

Some of the physics of plasma transparency and reflection are explained as follows. The plasma frequency is proportional to the density of unbound electrons in the plasma or the amount of ionization in the plasma. The plasma frequency sometimes referred to a cutoff frequency is defined as:

$$\omega_p = \sqrt{\frac{4\pi n_e e^2}{me}}$$

where $\eta_e$ is the density of unbound electrons, e is the charge on the electron, and me is the mass of an electron.

If the incident RF frequency ω on the plasma is greater than the plasma frequency $\omega_p$ the EM radiation passes through the plasma and the plasma is transparent, that is when:

$$\omega > \omega_p$$

When the opposite is true, plasma acts as a metal, and transmits and receives microwave radiation.

The electronically steerable and focusing plasma reflector antenna of the present inventor has the following attributes: the plasma layer can reflect microwaves and a plane surface of plasma can steer and focus a microwave beam on a time scale of milliseconds.

The definition of cutoff as used here is when the displacement current and the electron current cancel when electromagnetic waves impinge on a plasma surface. The electromagnetic waves are cutoff from penetrating the plasma. The basic observation is that a layer of plasma beyond microwave cutoff reflects microwaves with a phase shift that depends on plasma density. Exactly at cutoff, the displacement current and the electron current cancel. Therefore there is a anti-node at the plasma surface, and the electric field reflects in phase. As the plasma density increases from cutoff the reflected field increasingly reflects out of phase. Hence the reflected electromagnetic wave is phase shifted depending on the plasma density. This is similar to the effects of phased array antennas with electronic steering except that the phase shifting and hence steering and focusing comes from varying the density of the plasma from one tube to the next and phase shifters used in phased array technology is not involved.

This allows using a layer of plasma tubes to reflect microwaves. By varying the plasma density in each tube, the phase of the reflected signal from each tube can be altered so the reflected signal can be steered and focused in analogy to what occurs in a phased array antenna. The steering and focusing of the mirror can occur on a time scale of milliseconds.

A basic plasma satellite (or other frequencies apply as well) uses a reflector antenna design is shown in FIG. 1 where two banks of perpendicular plasma tubes 12 and 14 are provided for steering and/or focusing in two dimensions is illustrated. This system can apply to both a moving or static surface 10 to which the tubes 12, 14 are mounted, and steer and/or focus satellite signals by varying the plasma density among the plasma tubes 12, 14, with computer control in space and/or time. The details of such a computer control are know in the art of plasma antennas and are not repeated here. The top layer of tubes 14 (those that are away from the wall 10) have plasma densities below cutoff and therefore refractive radiation while the bottom layer of tubes 12 (tubes against the wall 10) have plasma densities above cutoff and are therefore reflective of the radiation.

As shown in FIG. 1, the plasma satellite (or other frequency) antenna can be flush with the wall, roof or any static or moving surface schematically shown at 10, which can be flat or curved. They can also be mounted in other ways. The plurality of side-by-side plasma tubes 12 at the left and against or near the wall 10, are horizontal in FIG. 1 and are therefore perpendicular to the plural vertical plasma tube 14 in the right. On the left the band of tubes 12 containing plasma reflects EM waves and steers and focuses the beam in one direction. On the right the perpendicular bank of tubes 14 containing plasma reflects and steers and focuses the EM waves in the perpendicular direction. A horn antenna 16 in the lower right transmits or receives the EM waves. The banks of tubes 12, 14 containing plasma can be flush with a surface 10 or supported in other ways.

In FIG. 10 both banks of tubes have plasma densities below cutoff and are therefore both refractive. That there is no wall in this embodiment since free access for EM radiation is needed form both sides.

Receiving or transmitting plasma on metal horn antenna 16 carries signals to, e.g. a TV, radio, GPS, cell phone, etc. This system eliminates the usual needed parabolic dish. The tubes 12 and 14 are within a wavelength apart. Such a wavelength corresponds to the transmitted or received frequency. This system can be completely encapsulated in Synfoam (a trademark for commercial rigid foam product) or other encasing, radio transparent material, for an aesthetical shape. The plasma in tubes 12 into the page, steer and/or focus satellite signals in the z direction. Plasma in tubes 14 parallel to the page steer and/or focus satellite signals azimuthally. One dimensional (with one bank of tubes) steering and/or focusing may be enough for the static satellite plasma antenna.

The plasma container walls of the invention can be made of any material that is substantially transparent to the type of radiation to be processed by the plasma array, and that can withstand the temperature and pressure of the plasma.

Examples are glass tubes, plastic tubes with a glass liner (for example glass tubes with socket type joints disclosed http://en.wikipedia.org/wiki/Ground_glass_joint), a resistant plastic tube (e.g. silicone), or Synfoam™ material.

Figure 2A:
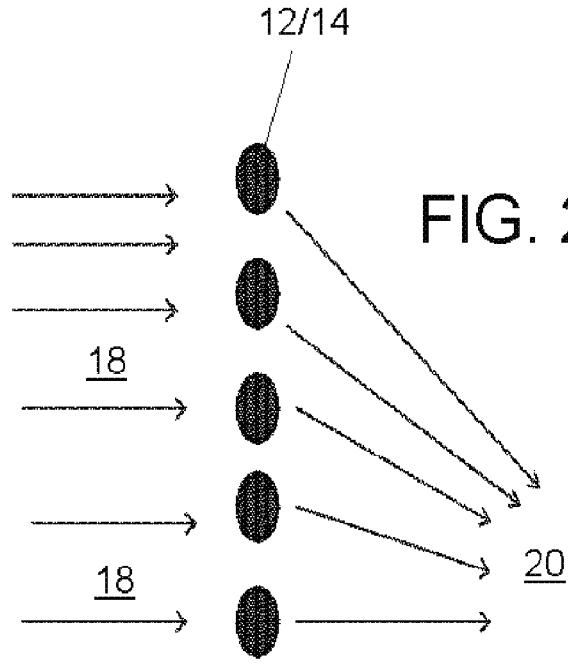
FIG. 2A is a view of some of the plasma tubes or antennas of the first embodiment for steering a microwave beam.

Steering and focusing can also be achieved when the plasma density is below cutoff. An effective Snells Law causes refraction of electromagnetic waves passing through a plasma of variable density (plasma density varying from container-to-container or tube-to-tube containing plasma). The speed of electromagnetic waves in a plasma is a function of plasma density. As shown in FIG. 2A, incident RF waves 18 on the left impinge on plasma tubes 12 and/or 14 with different densities but with the plasma densities below cutoff. Focusing or steering at 20 can be achieved depending on how the plasma densities are varied from tube to tube. As shown in FIG. 2B, incident RF waves on the left impinge on the plasma tubes with different densities but with the plasma densities below cutoff. Focusing or steering can be achieved depending on how the plasma densities are varied from tube to tube. FIG. 2B is a reflective counterpart to FIG. 2A.

The electronically steerable and focusing plasma reflector antenna of the invention can be made by having plasma densities in the tubes above cutoff but with the plasma densities varying from tube to tube. The electronically steerable and focusing bank of plasma tubes can be made by having plasma densities in the tubes below cutoff but with the plasma densities varying from tube to tube. Electronic steering and focusing in either of the above cases can be made in two dimensions by having two perpendicular banks of tubes. This can also steer and focus horizontal, vertical, circular, and elliptically polarized signals. With plasma electronic steering and focusing: parabolic reflector antennas are not needed; is in many ways a superior alternative to electronic steering with phased arrays; and at satellite frequencies the plasma antenna has much less thermal noise than metal antennas. The plasma antenna or array of the invention can provide better performance satellite communications antennas than metal antennas.

FIG. 3 illustrates a further embodiment of the directional and steerable multi-pole plasma antenna or array of the present invention where a ring of plasma antennas or plasma filled containers or tubes 22 (shown all off and therefore dark, white tubes symbolizing plasma tubes that are on) of diameter L with a plasma antenna 24 in the center. For practicality all the plasma antennas 22 and 24 are placed in a cylindrical mold 26 of Synfoam of other rigid encasing material as shown in FIG. 4. FIG. 5 illustrates the case where two plasma antennas 22*a* and 22*b* are turned on at opposite sides and out of phase with each other.

Referring now to FIG. 7 and the equation:

$$E = E_0\cos k\left(x - \frac{L}{2}\cos\theta\right) - E_0\cos k\left(x + \frac{L}{2}\cos\theta\right)$$

where $k=2\pi/\lambda$ ($\lambda$ being the wavelength) and assuming that:

$$\frac{kL}{2} < 1$$

the wavelength is large compared to the plasma antenna system of diameter L. The result is:

$$E=E_0(\sin kx)kL\cos\theta$$

This is a two lobe radiation pattern, but directional. The two lobes of the plasma antenna are oscillating out of phase.

With three plasma antennas in a straight line according to FIG. 6 the two outside antennas radiating in phase and the center antenna radiating out of phase but with double the signal strength, the far field E field with the two plasma antennas radiating in phase and a plasma antenna with double the signal strength and oscillating out of phase is:

$$E = E_0\left[\cos k\left(x - \frac{L}{2}\cos\theta\right) - 2\cos kx + \cos k\left(x + \frac{L}{2}\cos\theta\right)\right]$$

Assume that:

$$\frac{kL}{2} < 1$$

the wavelength is large compared to the antenna diameter L. The result is:

$$E = E_0\left[-\cos kx\left[\left(\frac{kL}{2}\cos\theta\right)^2\right]\right]$$

This is a two lobe plasma antenna with both lobes in phase as in FIG. 6.

As shown in FIG. 8, three plasma antennas in a straight line according to the invention use the two outside plasma antennas radiating out of phase (a dipole) and a center antenna oscillating in phase with one of the antennas in this case the one on the right (a monopole).

The resulting radiation E field from the plasma dipole and monopole plasma antennas is:

$$E=E_0[1+\cos\theta]\sin kx$$

This is a one lobe directional radiation pattern which is unattenuated in wavelength.

Some conclusions that can be drawn are that low frequency directional plasma antenna systems that can fit on vehicles are possible because: plasma antennas can be turned on and off this cannot be done with metal antennas; and multi-pole expansions of the plasma antennas allow the size of the plasma antenna system to be small and fit on a vehicle.

Steering plasma antennas in a multi-pole configuration can be accomplished by: turning a sequence of a line of plasma antennas on and off in a ring geometry with one plasma antenna in the center.

The invention applies to all frequencies, but practically speaking, the multi-pole expansions designs of FIGS. 3, 4, 5, 6, 7 and 8 apply to frequencies in which the operating frequencies are between 300 Hz and 300 MHz and the plasma frequencies are between 100 Hz and 900 MHz. The embodiments of FIGS. 1 and 2, apply mainly to satellite operating frequencies between 12 GHz and 40 GHz and the plasma frequencies range from 1 GHz to 150 GHz. The plasma frequency is proportional to the square root of the plasma density.

It is also noted that the plasma containers with varying plasma density among the containers together can create a continuous sheet of plasma having a varying plasma density across the sheet.

While specific embodiments of the invention have been shown and described in detail to illustrate the application of the principles of the invention, it will be understood that the invention may be embodied otherwise without departing from such principles.

What is claimed is:

1. A plasma array comprising: a plurality of plasma containers of selected shapes and a selected spacial distribution, the containers containing variable plasma density within each container and from one container to the next for establishing plasma frequency ranges from zero to an arbitrary plasma frequency, including a horn antenna having an inlet opening facing a plane created by the plasma container distribution for EM signal focusing.

2. The plasma array of claim 1, wherein between an incident EM antenna beam and the horn antenna an EM signal is focused and/or steered by the selected plasma density within each container and from one container to the next.

3. The plasma array of claim 1, wherein the plasma containers are excited by continuous or pulsing energy.

4. The plasma array of claim 1, wherein the plurality of plasma containers comprise a plurality of side-by-side parallel plasma-containing tubes, the plasma being excited at a selected frequency and the tubes being distributed to be within a wavelength of the selected frequency apart from each other.

5. The plasma array of claim 1, wherein the plurality of plasma containers comprise a plurality of side-by-side parallel plasma-containing tubes distributed in a circle with on additional plasma containers near a center of the circle.

6. The plasma array of claim 1, wherein the plurality of plasma containers creates a continuous sheet of plasma having a varying plasma density across the sheet.

7. A plasma array comprising: a plurality of plasma containers of selected shapes and a selected spacial distribution, the containers containing variable plasma density within each container and from one container to the next for establishing plasma frequency ranges from zero to an arbitrary plasma frequency, including two banks of plasma containing tubes with plasma density above cutoff with one bank perpendicular to and displaced from the other.

8. The plasma array of claim 7, wherein the two banks of tubes with plasma density above cutoff are arranged such that one bank of tubes reflects with steering, and focusing the electromagnetic beam in one direction and the other bank of tubes, which is displaced from the second set of tubes a distance of within one wavelength to many wavelengths apart, reflects the beam from a first reflector and reflects the electromagnetic beam with steering and focusing in the perpendicular direction.

9. The plasma array of claim 7, comprising a multi-pole expansion of plasma antennas each comprising on the plasma containers.

10. The plasma array of claim 9, wherein an antenna beam for both transmission and reception is steered by turning a selected number of the plasma contained on or off to change the multi-pole expansion of the plasma antennas.

11. A plasma array comprising: a plurality of plasma containers of selected shapes and a selected spacial distribution, the containers containing variable plasma density within each container and from one container to the next for establishing plasma frequency ranges from zero to an arbitrary plasma frequency, wherein the plurality of plasma containers comprise a plurality of side-by-side parallel plasma-containing tubes distributed in a pair of planes with the plasma containers in one plane being substantially perpendicular to the plasma containers in the other plane.

12. The plasma array of claim 11, including a wall adjacent one set of tubes, the set of tubes spaced away from the wall have plasma densities therein that are below cutoff and therefore refractive of radiation and the set of tubes adjacent the wall have plasma densities above cutoff and are therefore being reflective of radiation.

13. The plasma array of claim 11, wherein one plurality of tube have plasma densities above cutoff and therefore being reflective of radiation.

14. The plasma array of claim 11, wherein both pluralities of tubes have plasma densities below cutoff and therefore being refractive of radiation.

15. A method for steering or focusing EM radiation comprising: providing a plasma array of a plurality of plasma containers of selected shapes and a selected spacial distribution; and operating the containers to contain variable plasma density within each container and from one container to the next for establishing plasma frequency ranges from zero to an arbitrary plasma frequency, for one of steering and focusing EM radiation to the antenna array, wherein the plurality of plasma containers comprise two sets of side-by-side parallel plasma-containing tubes distributed in a pair of planes with the plasma containers in one plane being substantially perpendicular to the plasma containers in the other plane, and a wall adjacent one set of tubes, the set of tubes spaced away from the wall have plasma densities therein that are below cutoff and therefore refractive of radiation and the set of tubes adjacent the wall have plasma densities above cutoff and are therefore being reflective of radiation.

16. The plasma array of claim 15, wherein the plasma array is operating in a mode to at least one of: transmit; receive; filter; reflect; and refract radiation.

17. The plasma array of claim 15, including controlling at least one of voltage, current, power, microwaves, laser beams and acoustics applied to the plasma containers.

18. The plasma array of claim 15, including varying pulse time durations followed by afterglow or relaxation time durations for the plasma containers.

19. The method of claim 18, including operating the plasma containers in at least one of transmission, reception, and filtering during both a pulse duration and an afterglow duration of the plasma.

20. The method of claim 18, including operating the plasma containers in at least one of transmission, reception and filtering during an afterglow duration of the plasma.

21. The plasma array of claim 15, including spacing the containers containing plasma to be within one wavelength of the frequencies the EM radiation.

22. The method of claim 15, including operating the plurality of plasma containers to create a continuous sheet of plasma having a varying plasma density across the sheet.

23. A method for steering or focusing EM radiation comprising: providing a plasma array of a plurality of plasma containers of selected shapes and a selected spacial distribution; and operating the containers to contain variable plasma density within each container and from one container to the next for establishing plasma frequency ranges from zero to an arbitrary plasma frequency, for one of steering and focusing EM radiation to the antenna array, wherein the plurality of plasma containers comprise a plurality of side-by-side parallel plasma-containing tubes distributed in a pair of planes with the plasma containers in one plane being substantially perpendicular to the plasma containers in the other plane, one plurality of tube have plasma densities above cutoff and therefore being reflective of radiation.

24. A method for steering or focusing EM radiation comprising: providing a plasma array of a plurality of plasma containers of selected shapes and a selected spacial distribution; and operating the containers to contain variable plasma density within each container and from one container to the next for establishing plasma frequency ranges from zero to an arbitrary plasma frequency, for one of steering and focusing EM radiation to the antenna array, both pluralities of tubes have plasma densities below cutoff and therefore being refractive of radiation.

* * * * *